United States Patent [19]

Marker et al.

[11] 4,449,466

[45] May 22, 1984

[54] SAILBOARD

[75] Inventors: Hannes Marker, Hauptstrasse 51-53, 8100 Garmisch-Partenkirchen; Otto Hüss, Wallgau, both of Fed. Rep. of Germany

[73] Assignee: Hannes Marker, Garmisch-Partenkirchen, Fed. Rep. of Germany

[21] Appl. No.: 328,249

[22] Filed: Dec. 7, 1981

[30] Foreign Application Priority Data

Dec. 8, 1980 [DE] Fed. Rep. of Germany ..... 3046230
Jan. 19, 1981 [DE] Fed. Rep. of Germany ..... 3101465

[51] Int. Cl.[3] ..... B63B 15/00
[52] U.S. Cl. ..... 114/91; 114/39
[58] Field of Search ..... 114/39, 90, 91, 93; 441/74, 79; 403/297, 290, 353, 361, 366

[56] References Cited

U.S. PATENT DOCUMENTS 4,273,062 6/1981 Marker et al. ..... 114/91

FOREIGN PATENT DOCUMENTS 2901760 7/1980 Fed. Rep. of Germany .

*Primary Examiner*—Trygve M. Blix
*Assistant Examiner*—Jesus D. Sotelo
*Attorney, Agent, or Firm*—Fleit, Jacobson, Cohn & Price

[57] ABSTRACT

The sailboard has an opening, which contains a tongue of a mast base, which is articulatedly connected to the mast, so that the mast base is detachably connected to the sailboard. One side face of the opening is provided with a detent cam, which is adapted to be depressed against spring force and has an oblique or curved camming surface, which is adapted to snap behind the step or stop as the tongue is inserted into the opening.

30 Claims, 13 Drawing Figures

SAILBOARD

Figure 1:
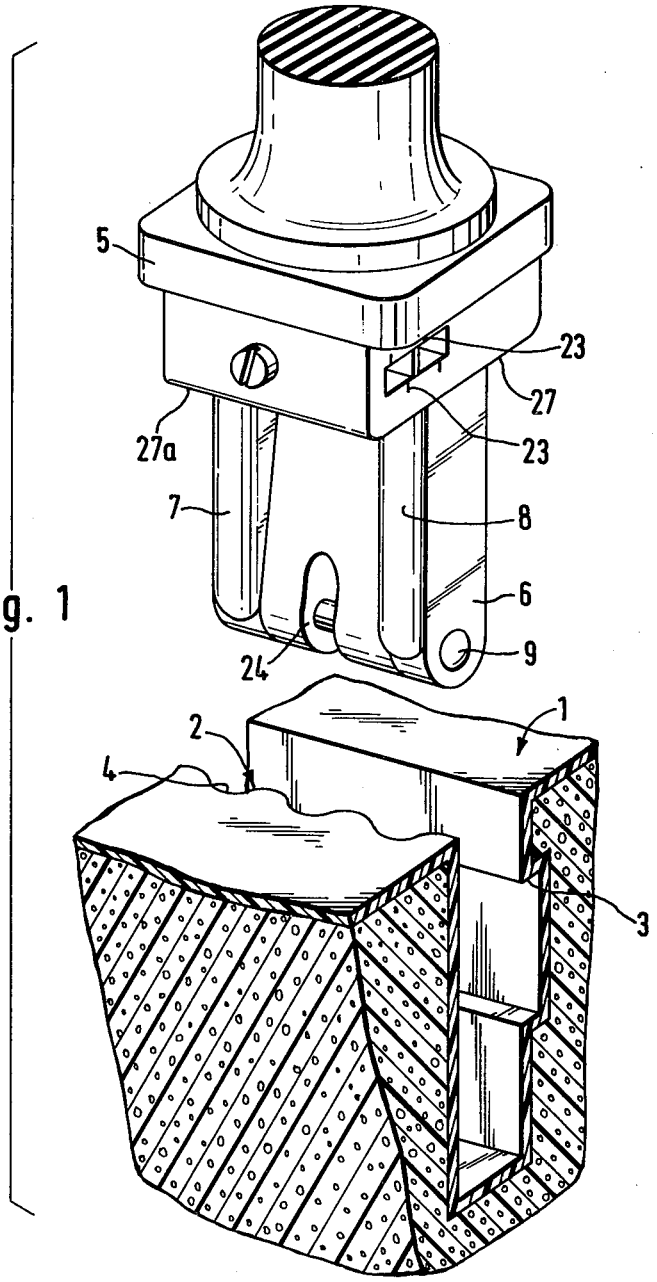

This invention relates to a sailboard, which has an opening, which contains a tongue of a mast base, which is articulatedly connected to the mast, so that the mast base is detachably connected to the sailboard.

In known sailboards, the mast base has a tongue or peg, which is inserted into a mating opening of the sailboard so that the mast base can be lifted and separated from the sailboard without need for overcoming an obstacle, merely in that the mast is lifted. Whereas these known joints between the mast base and the sailboard do meet the requirement that the mast base should easily be detachable from the sailboard so that parts of the body of the surfer cannot be injured in that they are clamped between the mast and the sailboard, such a loose joint often permits an undesired separation of the mast from the sailboard so that the handling of the craft during surfing is rendered more difficult.

For this reason it is an object of the invention to provide between the mast base and the sailboard a joint which ensures that the two parts will be separated in case of danger and that an undesired separation of the two parts will be avoided.

This object is accomplished according to the invention in that one side face of the opening is provided with a re-entrant step or with a stop and the tongue is provided with a detent cam, which is adapted to be depressed against spring force and has an oblique or curved camming surface, which is adapted to snap behind the step or stop as the tongue is inserted into the opening. The spring force is so selected that the tongue will be pulled out of the opening when the mast has fallen down and clamps members of the body of the surfer, and that the mast base is so firmly held in the opening that the mast base and the sailboard will not be separated by the usual forces which occur during surfing.

According to a preferred further feature of the invention the opening may consist of a narrow elongated recess, which extends in the longitudinal direction of the board, and one side face of the recess is formed with grooves, which extend at right angles to said recess and receive at least one projection of the tongue. With that design, the mast base can be shifted along the board in adaptation to wind and water conditions.

According to a particularly preferred feature, the side faces of the narrow elongated recess are formed with a re-entrant step, which is parallel to the top of the board, and with spaced apart parallel grooves, which extend at right angles to the step, the tongue carries at least one projection, which extends into the grooves, and the curved or oblique camming face of the detent cam engages said step so that the tongue can be pulled out of the groove against the spring force.

In order to permit a simple shifting of the mast forwardly and rearwardly during surfing, another preferred feature of the invention resides in that a pushbutton is provided, which comprises a slider, which extends through the body of the mast base in an aperture which extends transversely to the mast and in the direction of the opening, said slider is provided at both ends with pushpieces for actuating the slider from both sides of the mast base, said slider is held in an intermediate position by the resilient means which bias the unlockable projection, and the slider can be shifted out of said intermediate position to unlock the tongue. This arrangement according to the invention permits a simple handling because the tongue can be unlocked in that pressure is applied, e.g., with a foot, to either of the pushpieces, and the pressure required to shift the mast base in the desired direction can be applied to the mast base at the same time. When the pushpieces are released, the slider will automatically return to its intermediate position, in which the projection for locking the mast base is received by a groove formed adjacent to the shifted mast base in the side face of the recess.

The disengageable projection may consist of a spring wire, which is secured at one end to the tongue and in its locking position is disposed centrally between converging wedgelike edges of the slider so that the projection will be moved out of the grooves in reponse to the movement of the slider in one direction or the other. The slider may be connected to a bar, which has a V-shaped recess, the side faces of which constitute the wedgelike edges.

One end of the spring wire is suitably secured to a lever, which is disposed in and pivoted to the tongue and carries the detent cam, which holds the mast base against axial movement. In that embodiment, only one spring wire is required to lock the mast base against a movement in the axial and transverse directions.

According to a further preferred feature of the invention the top portion of the mast base is annular and has a beadlike edge, which cooperates with a complementary annular groove in the adjacent portion of the mast to form a universal joint, and the mast base and the adjacent portion of the mast are held together by an elastic tensile element. In normal position of use, the elastic tensile element holds the mast base and the adjacent portion of the mast together so that their curved surfaces in frictional contact with each other constitute a universal joint. When the mast is subjected to forces tending to eliminate the universal joint, the elastic tension element will permit a separation of the articulated joint so that injury to the surfer will be avoided. For a renewed use of the mast, the elastic tensile element again pulls the mast to the mast base so that the articulated joint will be automatically re-established and there will be no need for special manipulations to reconnect the mast base to the sailboard.

Additional preferred features of the invention will be recited in the dependent claims.

Figure 2:
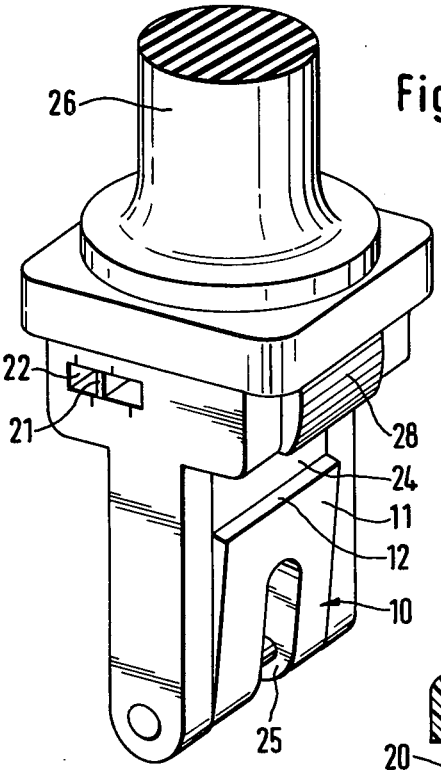
Figure 3:
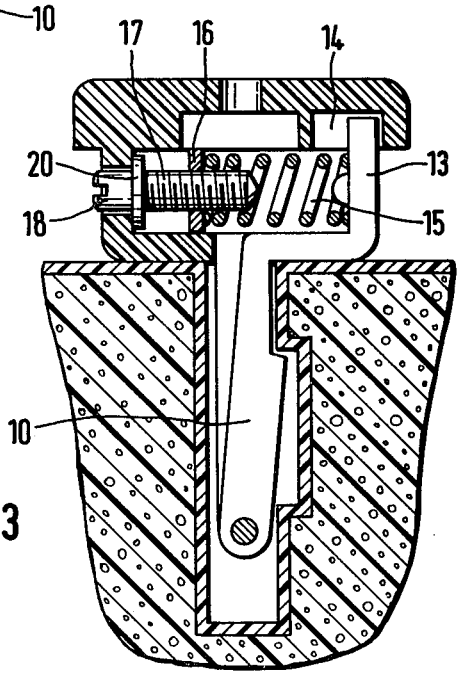
Figure 4:
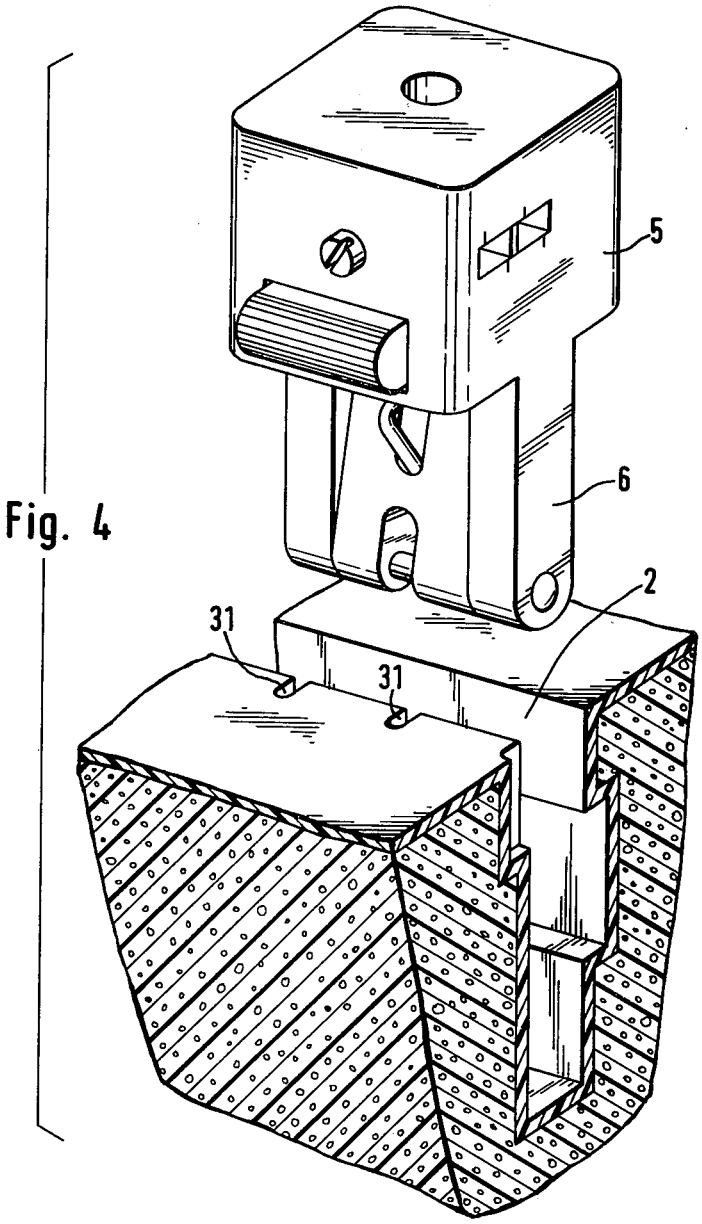
Figure 5:
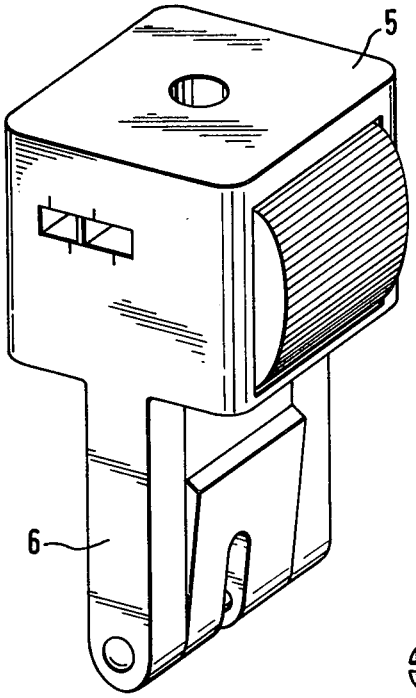
Figure 6:
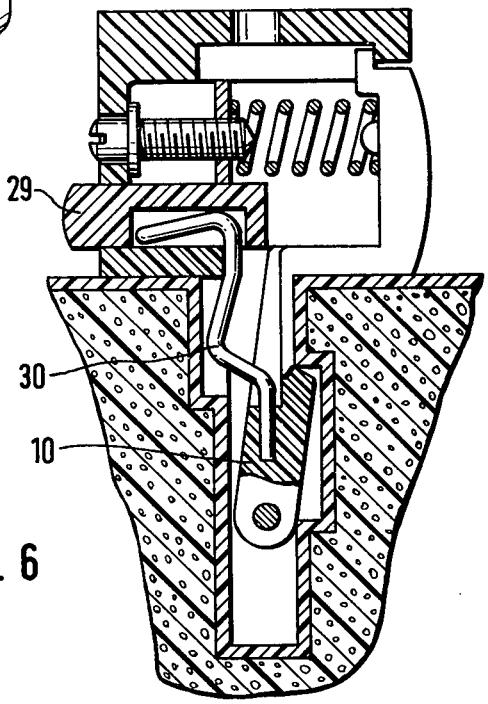
Figure 7:
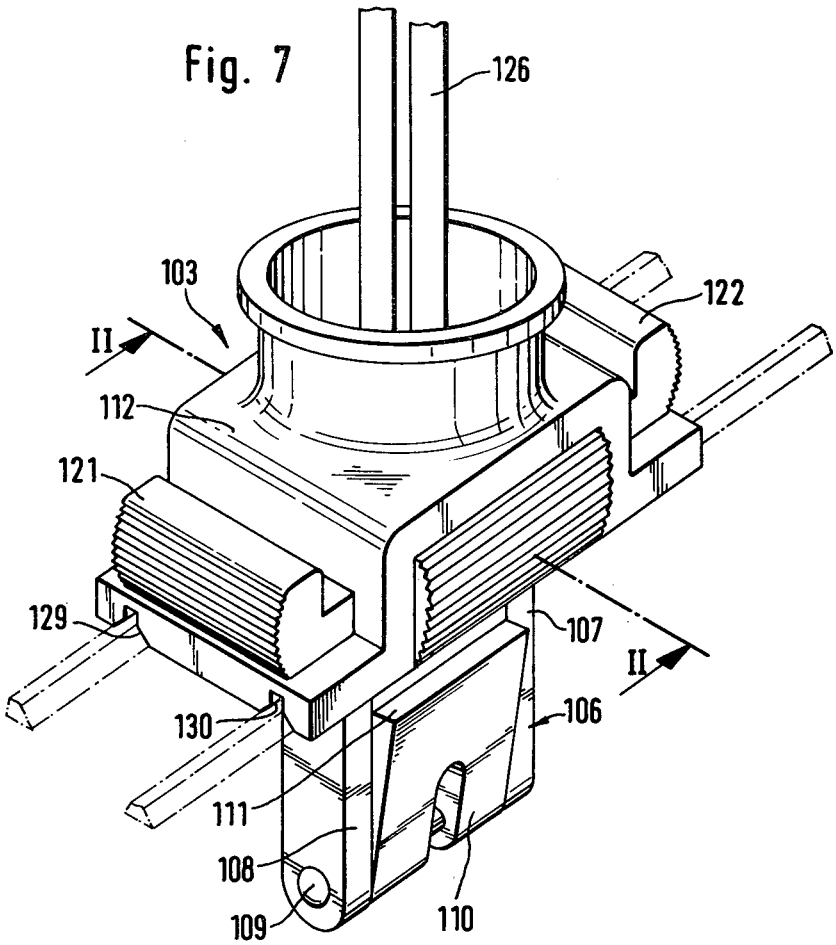
Figure 8:
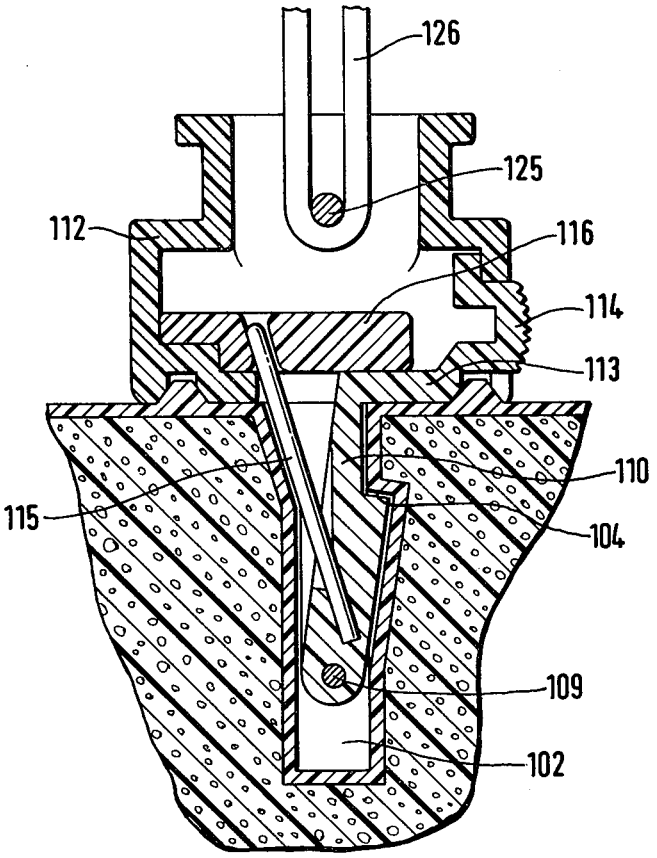
Figure 9:
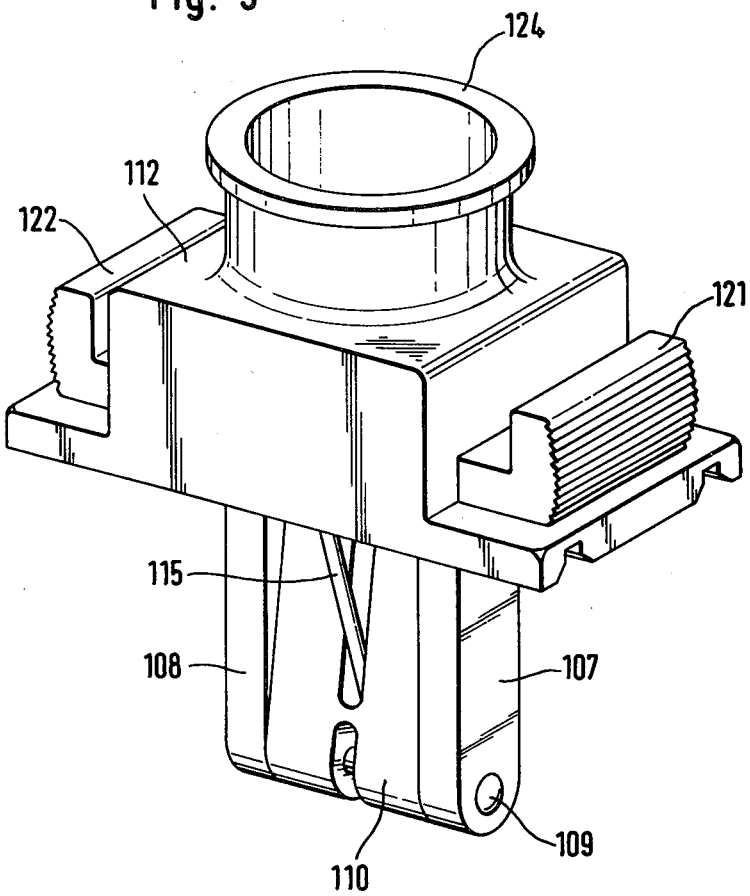
Figure 10:
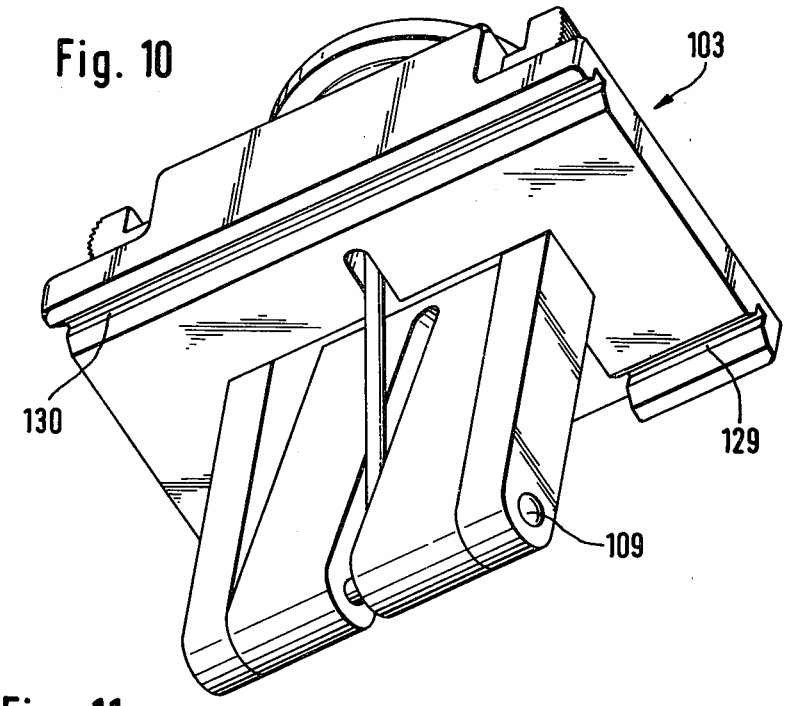
Figure 11:
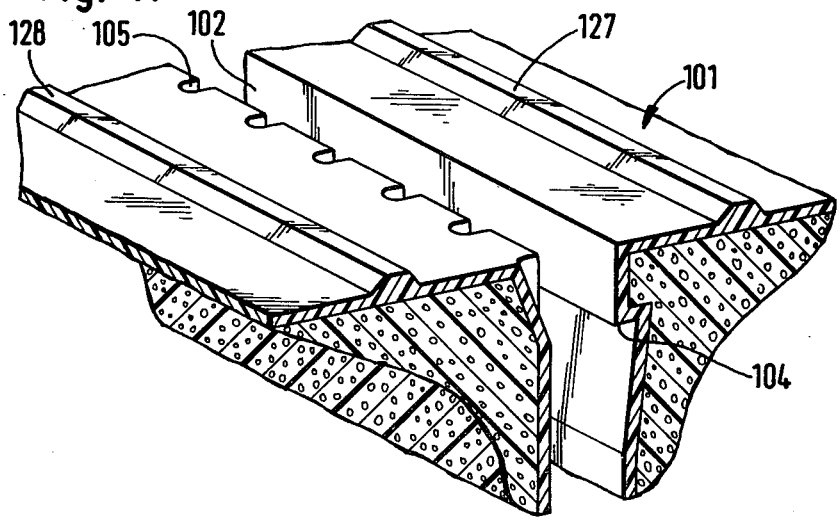
Figure 12:
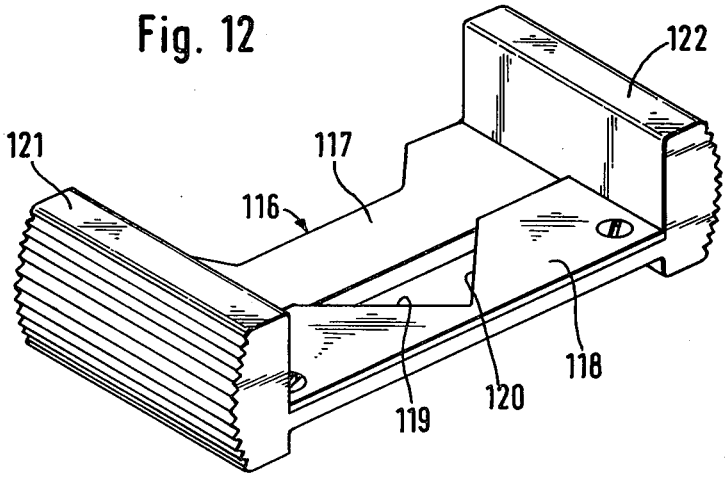
Figure 13:
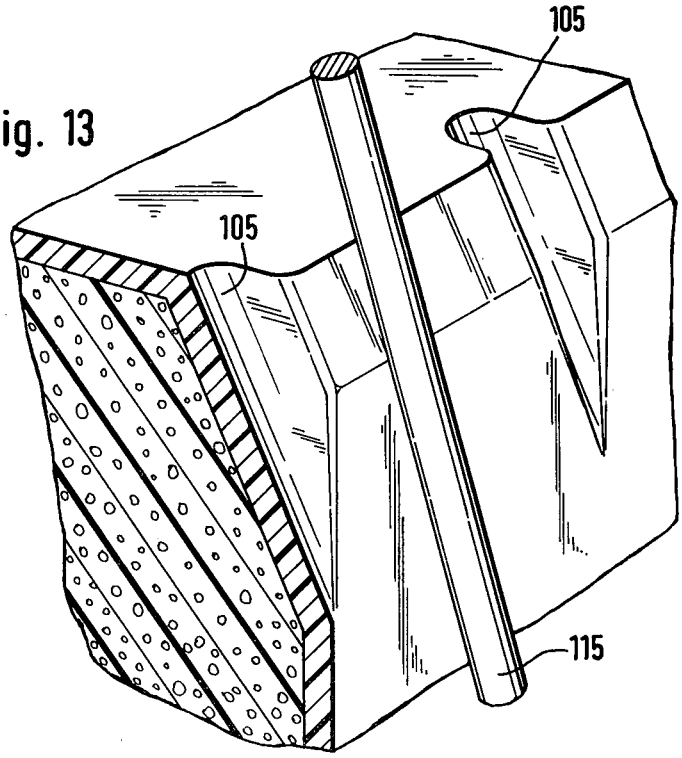

Illustrative embodiments of the invention will be described more fully with reference to the drawings, in which:

FIG. 1 is a perspective view showing a first embodiment comprising a sailboard having an elongated recess, and a mast base prior to its insertion into the recess, FIG. 2 is a perspective view showing the mast base of FIG. 1 as seen from that side of its tongue which is provided with the detent cam, FIG. 3 is a longitudinal sectional view showing the mast base which has been inserted into and locked in the recess, FIGS. 4 to 6 are views corresponding to FIGS. 1 to 3 and show a second embodiment of a mast base and the associated recess, FIG. 7 is a perspective view showing the mast base of a third embodiment as viewed on that side face of the tongue which is provided with the detent cam, FIG. 8 is a longitudinal sectional view taken on line II—II in FIG. 7 and showing the mast base, FIG. 9 is a perspective view showing the mast base of FIGS. 7 and 8 as viewed on that side face of the tongue which is provided with the disengageable projection, FIG. 10 is a perspective view of the mast base of FIGS. 7 to 9 viewed from below, FIG. 11 is a perspective view showing partly in section the opening in the sailboard of FIGS. 7 to 10, FIG. 12 is a perspective view showing the slider of the third embodiment and FIG. 13 is a perspective view showing that side face of the opening of the third embodiment which is provided with vertical detent grooves.

The sailboard 1 is formed with a longitudinally extending, elongated recess, which is as long as the region in which the mast is to be shiftable.

One side face of the recess is formed with a re-entrant step 3, which is parallel to the top face of the board. The opposite side face has a wave-shaped profile, the wave troughs of which constitute grooves 4, which extend at right angles to the step 3.

The mast base 5 is substantially T-shaped in cross-section and its leg constitutes a tongue 6, which is adapted to be inserted into the recess 2. Projecting ribs 7, 8 are formed on one side face of the tongue and have the same spacing as the grooves 4.

On the opposite side, the tongue 6 is formed with a recess, in which a lever 10 is disposed, which is pivoted on a pin 9 that is secured to the lower portion of the tongue 6. The lever 10 comprises a detent cam 11, which is formed by a step in the lever 10 and has an oblique camming face 12. At its top end, the lever 10 comprises a leg 13, which is laterally offset from the lower portion of the lever 10 and extends approximately parallel to the tongue 6 and into a recess 14 formed in the body of the mast base. The forward and rear ends of the recess 14 constitute stops, which limit the pivotal movement of the lever 10.

The body of the mast base 5 is formed with a bore, which contains a compression spring 15, which bears at one end on the leg 13 of the lever 10 and at its other end on a spring abutment 16, which is axially slidably and non-rotatably mounted in the bore and has screw threads for engaging an adjusting screw 17. The head 18 of the set screw 17 protrudes out of the constricted end portion of the bore. A collar 20 of the screw 17 bears on the annular inner end face of said end portion of the bore. The adjusting screw 17 can be rotated to change the initial stress of the spring 15. The spring abutment 16 has an extension, which constitutes a pointer 21, which protrudes into a window 22 of the body of the mast base 5. The edges of said window are provided with scales 23 from which the adjusted spring force can be read.

The tongue 6 and the lever 10 have forked lower portions, which are formed with respective recesses 24, 25. The pin 9 extends through the recess 25 so that an eyelet is formed, in which a retaining rope can be secured.

A rubber member 26 is secured to the body of the mast base 5 and constitutes a universal joint between the mast and the mast base.

As the tongue 6 has the same width as the elongated recess 2, the mast base will be fixed in the recess 2 when the tongue 6 has been inserted into the recess 2. When the tongue 6 has been inserted, the bottom surface portions 27, 27 of the body of the mast base 5 bear on the top face of the sailboard.

The leg 13 of the lever 10 is provided with an outwardly protruding knob 28, which can be actuated to disengage the cam 11 from the step 3.

The wave-shaped profile of one side face of the recess permits the mast base to be shifted in small steps.

In the embodiment shown in FIGS. 4 to 6, a shifting of the mast base along the board is prevented by a spring wire 30, which is secured at one end to the tongue 6 and at the other end to a pushbutton 29, which is mounted in the body of the mast base 5 for a limited longitudinal displacement. The spring wire 30 comprises a bend, which enters detent grooves 31 formed in one side face of the elongated recess 2. By the actuation of the pushbutton 29, the bend of the spring wire 30 can be moved out of the detent grooves. The pushbutton 29 may be replaced by a pedal, which is desirably arranged in such a manner at the body of the mast base 5 that the surfer can use his foot to actuate the pedal and to shift the mast as desired during surfing.

Alternatively, the lower end of the spring wire 30 can be secured to the lever 10 so that the spring wire 30 biases also the detent cam 11.

In the third embodiment shown in FIGS. 7 to 13, the sailboard 101 is formed with a longitudinally extending elongated recess 102 for holding the mast base 103 and guiding the same as it is longitudinally shifted.

One side face of the recess 102 is formed with a re-entrant step 104, which is parallel to the top face of the board. The opposite side face of the recess 102 is formed with spaced apart grooves 105, which extend in transverse planes that extend at right angles to the longitudinal direction of the recess 102 and are inclined relative to the center plane of the recess 102 so that they are formed only in the upper portion of the side face.

The mast base 103 is substantially T-shaped in cross-section and its leg constitutes a tongue 106, which is adapted to be inserted into the recess 102. The tongue consists of parallel arms 107, 108, which ae respectively provided at the forward and rear ends of the tongue and at their lower end are connected by a pivot pin 109. A lever 110 is pivoted on the pin 109 and is formed with a step, which constitutes a detent cam 111. When the tongue has been inserted into the recess 102, the detent cam 111 snaps behind the re-entrant step 104, as is apparent from FIG. 8.

The arms 107, 108 are secured to the body 112 of the mast base. The body 112 is substantially parallelepipedic. The lever 110 is angled as shown in FIG. 8 and its laterally offset top end portion 113 carries a pushbutton 114, which extends through an opening in a side wall of the body 112 so that the pushbutton 114 can be actuated from the outside.

A spring wire 115 is secured in a bore of the lever 110 as is apparent from FIG. 8. The bore has a curved top end portion so that the spring wire 115 can be freely deflected. Under initial stress, the spring wire 115 enters the grooves 105 in the side face of the recess 102 and thus constitutes a locking member, which prevents a shifting of the mast base 103 along the sailboard, and a spring, which biases the lever 110 to hold the mast base 103 against a vertical movement.

The body 112 is formed with a through hole, in which a slider 116 is longitudinally slidably mounted. The slider 116 has an intermediate portion 117, which is connected by screws to a steel strap 118. As is shown in FIG. 12, the strap 118 has a V-shaped notch, which together with the intermediate portion 117 constitutes a triangular opening. The top end portion of the spring wire 115 extends at least in part through said triangular opening and in response to a shifting of the slider 116 in one direction or the other will engage either of the oblique edges 119, 120 of the V-shaped notch so that the spring wire 115 will be moved out of the grooves 105. Pushpieces 121, 122 are secured to the ends of the intermediate portion 117 of the slider 116. Pressure can be applied to said pushpieces 121, 122, e.g., by the foot, when it is desired to unlock the mast base and to shift it along the board.

The top end of the body 112 is formed with an annular peripheral edge bead 124, which constitutes part of the universal joint between the mast base 103 and the mast. That universal joint has been described more in detail in PCT Application PCT/EP 80/00117.

A transverse pin 125 is secured in the body 112 and serves to anchor a rubber strip 126, which holds the mast base 103 and a complementary connecting portion of the mast together.

The sailboard 101 is provided with guide ribs 127, 128, which are parallel to the recess 102 and when the mast base has been inserted are received by guide grooves 129, 130, which are formed in the bottom surface of the body 112 of the mast base. The guide ribs 127, 128 and the grooves 129, 130 ensure that the mast base will not be canted as it is shifted.

What is claimed is:

1. An apparatus for detachably connecting a mast having a mast base to a sailboard, said apparatus comprising a tongue connected to the mast base; an elongated recess in the top of the sailboard for receiving said tongue, said elongated recess extending in the longitudinal direction of the top of the sailboard; vertically-extending parallel grooves which are located in a lateral surface of said elongated recess, said grooves being longer in length than said tongue; at least one projection on a side of said tongue said projection being provided to engage with said vertically-extending parallel grooves.

2. An apparatus to claim 1, further comprising a re-entrant step in the lateral surface of said elongated recess which is opposite said vertically-extending parallel grooves, said re-entrant step being parallel to the top face of the sailboard.

3. An apparatus according to claim 1, further comprising a depressible detent cam on the side of said tongue which is opposite from said projection, said detent cam being provided with an oblique camming surface.

4. An apparatus according to claim 3, further comprising means for pivotally connecting said detent cam to said tongue.

5. An apparatus according to claim 4, wherein said means for pivotally connecting said detent cam to said tongue is a pivot pin which extends through said detent cam and said tongue.

6. An apparatus according to claim 3, further comprising a means for biasing said detent cam away from said tongue in such a manner that when said tongue is inserted into said elongated recess, said oblique camming surface snaps behind said re-entrant step.

7. An apparatus according to claim 6, wherein said means for biasing said detent cam is a compression spring.

8. An apparatus according to claim 6, wherein said means for biasing said detent cam is adjustable.

9. An apparatus according to claim 8, which further comprises a screw said screw being provided in said tongue for adjusting said compression spring provided in said tongue.

10. An apparatus according to claim 9, further comprising a means for indicating the force by which said compression spring will oppose an unlocking of said detent cam.

11. An apparatus according to claim 10, wherein said means for indicating said force is provided by a spring abutment which holds said compression spring under initial stress, and a pointer which is movable in unison with said spring abutment relative to a scale which appears on said tongue.

12. An apparatus according to claim 6, wherein said means for biasing said detent cam away from said tongue is one end of said projection on the side of said tongue which is opposite said detent cam.

13. An apparatus according to claim 3, further comprising a means for depressing said detent cam in such a manner that said oblique camming surface is released from engagement with said re-entrant step.

14. An apparatus according to claim 13, wherein said means for depressing said detent cam in such a manner that said oblique camming surface is released from engagement with said re-entrant step is a push-button on that portion of the mast base which is disposed above the top face of the sailboard.

15. An apparatus according to claim 13, wherein said means for depressing said detent cam is a lever which is pivotally connected to the lower portion of said tongue.

16. An apparatus according to claim 15, wherein the top end portion of said lever constitutes a push-button for unlocking said tongue.

17. An apparatus according to claim 3, wherein said projection is a spring wire which also biases said detent cam.

18. An apparatus according to claim 1, further comprising a means for disengaging said projection from said vertically-extending parallel grooves.

19. An apparatus according to claim 18, wherein said means for disengaging said projection from said vertically extending parallel grooves is a push-button which comprises a slider, said slider extending through a transverse aperture in said mast base, said slider being provided at both ends with push pieces for actuating said slider from both sides of said mast base, and said slider being held in an intermediate position by said projection on said tongue.

20. An apparatus according to claim 19, wherein said projection comprises a spring wire, one end of which is secured to said tongue, said spring wire being disposed between oppositely inclined edges of said slider when said spring wire is in the locked position, said spring wire being moved to an unlocked position by moving said slider in one direction or another.

21. An apparatus according to claim 20, wherein said slider is connected to a bar which has a V-shaped notch, the edges of which constitute said inclined edges.

22. An apparatus according to claim 20, wherein said oppositely inclined edges of said slider is formed by a bar which is connected to an intermediate portion of said slider, said bar forming a triangular opening for receiving said spring wire.

23. An apparatus according to claim 1, wherein said vertically-extending parallel grooves are formed by a wave-shaped profile on one lateral surface of said elongated recess.

24. An apparatus according to claim 1, wherein said projection is a rib which is integral with said tongue.

25. An apparatus according to claim 1, wherein said projection is a detent nose which is adapted to be depressed against spring force.

26. An apparatus according to claim 25, wherein said detent nose is depressed by means of a push-button which is provided in the mast base.

27. An apparatus according to claim 1, wherein said mast base is provided with an eye for connection to a retaining rope.

28. An apparatus according to claim 27, wherein said eye is formed by a recess formed in said tongue; and a pivot pin.

29. An apparatus according to claim 1, wherein said mast base is annular, said annular mast base having a V-shaped edge portion which cooperates with a complementary annular groove of the connecting portion of the mast in such a manner as to form a universal joint, said mast base and said connecting portion being held together by an elastic tensile element.

30. An apparatus according to claim 1, wherein the top surface of the sailboard is provided with guide ribs on both sides of said elongated recess, said guide ribs being parallel to said recess, and said guide ribs being received by guide grooves which are formed on the underside of the body of said mast base.

* * * * *